United States Patent [19]

Zettergren

[11] Patent Number: 4,605,042

[45] Date of Patent: Aug. 12, 1986

[54] PILOT OIL SUPPLY ARRANGEMENT

[75] Inventor: Ted Zettergren, Nyland, Sweden

[73] Assignee: Hydrino AB, Nyland, Sweden

[21] Appl. No.: 749,628

[22] PCT Filed: Nov. 7, 1984

[86] PCT No.: PCT/SE84/00379

§ 371 Date: Jun. 18, 1985

§ 102(e) Date: Jun. 18, 1985

[87] PCT Pub. No.: WO85/02233

PCT Pub. Date: May 23, 1985

[30] Foreign Application Priority Data

Nov. 9, 1983 [SE] Sweden ..... 8306179

[51] Int. Cl.[4] ..... F15B 13/02

[52] U.S. Cl. ..... 137/596.12; 91/446; 91/527; 91/529; 137/596.16; 137/625.64

[58] Field of Search ..... 91/446, 527, 529; 137/596.12, 596.16, 625.64

[56] References Cited

U.S. PATENT DOCUMENTS

| | | | |
|---|---|---|---|
| 3,709,103 | 1/1973 | Dukhovny et al. | 91/437 |
| 3,943,973 | 3/1976 | Zettergren | 91/527 X |
| 4,072,169 | 2/1978 | Heiser et al. | 137/625.64 X |

*Primary Examiner*—Gerald A. Michalsky

*Attorney, Agent, or Firm*—Silverman, Cass, Singer & Winburn, Ltd.

[57] ABSTRACT

An arrangement for supplying pilot oil to a servo-valve arranged to activate a main valve of a hydraulic system. The hydraulic system also includes a hydraulic oil pump, a valve located between the pump and the main valve, a pressure reducing valve located between the pump and the servo-valve, and at least one auxiliary assembly is arranged to deliver an electric signal to electromagnetic means arranged to activate the servo-valve. In accordance with the invention, the valve located between the pump and the main valve is arranged to be substantially or fully closed when standing at a given, pre-determined pressure corresponding to the servo pressure required by the servo-valve in order to carry out its intended function, and is arranged to be open when the pressure slightly exceeds the aforementioned pre-determined pressure. An electromagnetically operable shunt valve is located between the pump and pressure reducing valve and, when open, to pass oil direct from the pump to a tank. The shunt valve is arranged to take its closed position upon receipt of a signal delivered from the auxiliary assembly when same is activated in turn, to activate the servo-valve more than one auxiliary assembly can be used.

6 Claims, 2 Drawing Figures

PILOT OIL SUPPLY ARRANGEMENT

TECHNICAL FIELD

The present invention relates to an arrangement for supplying pilot oil to hydraulic valves of the kind used in hydraulically operated machines, such as cranes, mechanical diggers etc.

BACKGROUND ART

The hydraulic system used in such machines is provided with a main control valve which controls the flow of hydraulic oil to a plurality of hydraulic piston-cylinder motors which operate associated parts of the machine in question.

The main control valve comprises a number of slides which are activated by a servo-valve which incorporates a converter. In principle, the converters comprise a plunger which is axially movable in a cylindrical barrel or bore. The piston is activated electromechanically, and is displaced so that oil, i.e. pilot oil, is able to bypass the converter and therewith act upon the valve slides.

The present invention relates to the supply of oil to such servo-assemblies.

One known method of supplying oil to a servo-valve is to provide a separate oil pump therefor. This arrangement is encumbered with several disadvantages, however, and consequently the most common method used is one of providing a pump for the whole system and to channel off a given flow of oil from the pump and deliver it to the servo-valve. The invention relates to this latter type of system, which lacks the provision of a separate servo-pump.

In one such system, which is well known to the art, there is incorporated downstream of the pump a pressure compensated flow distributor, a so-called priority valve, which takes a part of the oil from the pump and delivers it to the servo-valve, while the remainder of the oil is conducted to the main valve. Arranged between the flow distributor and the servo-valve is a pressure control valve which opens at a given pressure, whereupon the divided oil flow is shunted directly to a tank. The flow distributor sends a constant flow of oil to the servo-valve.

The main disadvantage with this known system is that the set amount of oil passed to the servo-valve must always be greater than the maximum amount of oil consumed thereby.

Consequently, when the servo-valve is not activated, a considerable amount of oil will drain-off to the tank, via the pressure control valve, which results in unnecessary losses. In addition, the flow distributor must work at an internal pressure drop, in order to have a smooth and well-defined characteristic. If, on the other hand, the flow distributor is designed to work at the lowest possible drop in pressure, in order to avoid pressure losses, malfunctioning is likely to occur in the machinery being served. If the internal pressure drop is high, on the other hand, the pressure under which the main flow stands will naturally be affected, resulting in significant losses.

In another known, but less common system the flow distributor is replaced with a back pressure valve located between the pump and the main valve. This back-pressure valve is set for a pressure such that the valve will not open until a pressure which exceeds the necessary servo pressure is reached. A typical back pressure in this respect is 25 bars. Consequently, the resultant pressure losses are quite considerable, since the pump must constantly produce a pressure which is 25 bars higher than the pressure required at the moment in the main valve.

Both of these servo-valve oil supply systems result in significant losses when in operation.

Consequently, there is a need to design such a system in which the losses are considerably lower, or nonexistent.

This need is filled by means of the present invention.

According to the invention, there is provided a system in which losses are substantially eliminated.

DISCLOSURE OF THE INVENTION

Thus, the present invention consists in an arrangement for supplying pilot oil to a servo-valve arranged to serve a main valve in a hydraulic system which incorporates a hydraulic-oil pump, a valve located between the pump and the main valve, a pressure reducing valve located between the pump and the servo-valve, and one or more auxiliary assemblies arranged to deliver an electric signal to an electromagnetic means arranged to activate the servo-valve, the arrangement being characterized in that the valve located between the pump and the main valve is arranged to be substantially or fully closed under a given pre-determined pressure corresponding to the servo pressure required by the servo-valve in order to carry out its intended function; and in that said valve is arranged to be open when the pressure slightly exceeds said pre-determined pressure.

BRIEF DESCRIPTION OF THE DRAWINGS

The invention will now be described in more detail with reference to an embodiment thereof illustrated by way of example in the accompanying drawing, in which.

DESCRIPTION OF A PREFERRED EMBODIMENT

Figure 1:
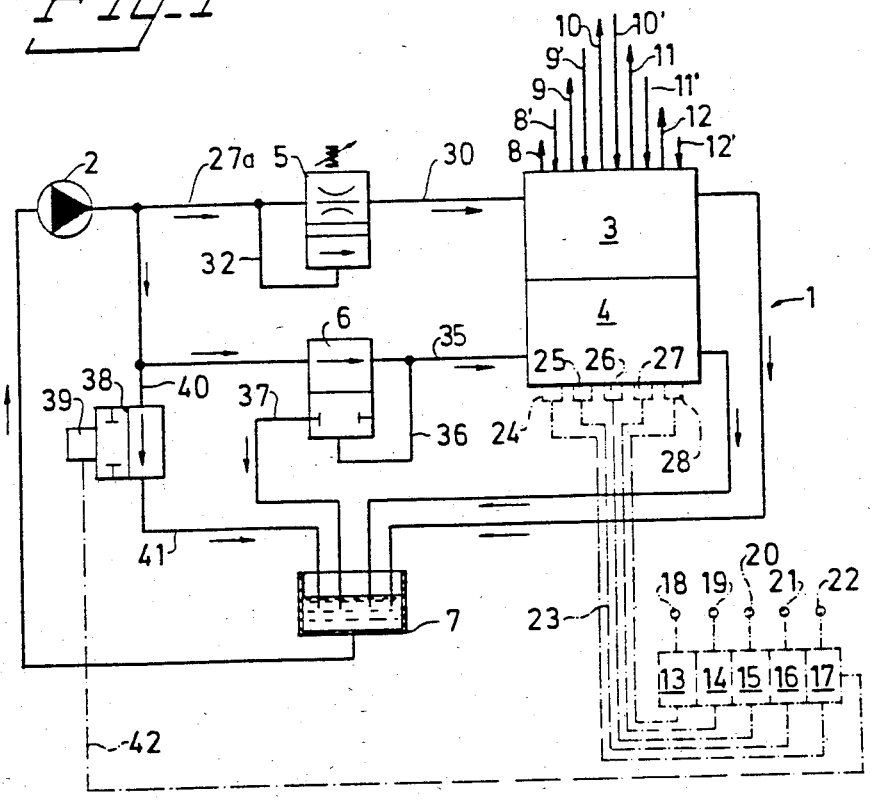
FIG. 1 is a block schematic of an arrangement according to the invention.

FIG. 1 illustrates schematically a hydraulic system 1 for a machine or similar apparatus.

The system incorporates a pump 2, a main valve 3, a valve 5 located between the pump and the main valve, a servo-valve 4 located downstream of the pump 2, and a pressure reducing valve located between the pump and the servo-valve.

Figure 2:
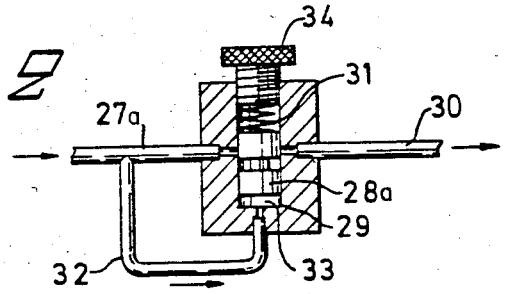
FIG. 2 illustrates in larger scale a principle design of a valve incorporated in said arrangement.

The illustrated hydraulic system further includes a tank 7 for collecting hydraulic oil or fluid from the servo-valve 4, and the hydraulic valve 3, and also return oil from hydraulic piston-cylinder motors 8–12, as indicated in FIG. 1, by the arrows referenced 8'–12', these motors being operated by the main valve 3. The flow directions are indicated in FIGS. 1 and 2 by means of arrows.

The servo-valve 4 is operated by means of a plurality of auxiliary assemblies 13–17 comprising electronic circuits and operating levers 18–22, these auxiliary assemblies being arranged to activate electromagnetic means 24–28, via electric conductors generally identified at 23, each of which electromagnetic means activates a slide in the servo-valve. The slides of the servo-valve 4 are arranged to activate corresponding slides of the main valve, so that oil is supplied to the cylinders 8–12 to an extent corresponding to the setting of the operating levers 18–22.

The components referenced 13–28 have been shown in chain lines, since these components may be of any desired design and can be replaced by totally different auxiliary assemblies. The particular design of these members is not significant to the present invention, other than in the respect given here below in conjunction with reference to a shunt valve 38.

According to the invention, the valve 5 located between the pump 2 and the main valve 3 is arranged to be closed, or substantially closed, when a given pre-determined pressure prevails in a line 27*a* extending from the pump 2. This pressure corresponds to the servo pressure required by the servo-valve 4 in order to carry out its intended function. The valve 5 is arranged to be open when the pressure in the line 27*a* slightly exceeds the aforesaid pre-determined pressure.

When the valve is open, the pressure drop across the valve is extremely low, and hence the pump pressure, for example 250 bars, produced by the pump 2 substantially also prevails in the main valve 3.

The valve 5 may be of any suitable design which results in the valve being closed at a pressure beneath the pre-determined pressure and to be open at a slightly higher pressure, where the pressure drop across the valve is slight when the valve is open.

According to one preferred embodiment of the invention, see FIG. 2, the valve 5 includes, however, a slide 28*a* which is movable in a cylindrical bore 29, the slide 28*a* in a first position, shown in FIG. 2, closing a passage 27*a*, 30 extending through the valve 5, and in a second position, in which the slide 28*a* is axially displaced in relation to the first position, opens said passage 27*a*, 30. In the FIG. 2 embodiment, the slide is displaced upwardly, to take said second position. When the valve 5 is arranged not to close fully in its first position, a hole may be drilled through the slide 28*a*, or the diameter of the slide 28*a* relative to the bore 29 may be such as to permit a given leakage of oil through the valve.

A spring 31 is arranged to urge the slide 28*a* towards its first position. Connected between the pump 2 and the valve 5 is an oil line 32 , which extends to a chamber 33 in the cylinder bore or barrel 29. The oil pressure in the line 27*a* acts upon the slide 28*a*, through the operating line 32, at a pressure which is at least equal to the aforesaid pre-determined pressure, in a manner to move the slide 28*a* from its said first position to its said second position, whereupon the valve opens the passageway 27*a*, 30.

The force exerted by the spring 31 can be adjusted by means of suitable devices, such as a knob 34, thereby to enable the valve to be set for the pre-determined pressure at which the valve shall open and beneath which the valve shall be closed.

The pressure reducing valve 6 is intended to maintain the servo pressure in the line 35 extending between the pressure reducing valve 6 and the servo-valve 4.

To this end there is provided an operating line 36 which extends from said line 35 to the pressure reducing valve 6. When the pressure in the line 35 is lower than the servo pressure, the pressure reducing valve 6 will open, while when the pressure exceeds the servo pressure the oil pressure in the operating line 36 activates the valve to its closed position. The system also includes a drainage line 37 which extends from the pressure reducing valve 6 to the tank 7 and through which leakage oil from the valve 6 is drained away. The servo pressure may, for example, be 20 bars. At a servo pressure of 20 bars, the valve 5 may be set to open at a pressure of about 25 bars, or in all events at a pressure slightly exceeding 20 bars.

When none of the operating levers 18–22 or like devices are activated, and thus none of the hydraulic motors 8–12 are activated due to activation of the main valve by the servo-valve, oil is shunted from the pump 2 to the tank 7 through the main valve 3. The pressure in the line 27*a* is then determined by the pre-determined opening pressure for valve 5. When an operating lever is activated, the pressure in the line 27 rises, causing the valve 5 to open. Oil will then flow through the main valve 3, to respective cylinder motors 8–12. The pressure in the line 35 is maintained, whereupon the servo-valve stands under sufficient pressure and is supplied with sufficient oil.

Thus, by means of the present invention, in operation the pump pressure is substantially maintained to the main valve, and therewith the cylinder motors 8–12 in question, while maintaining the servo pressure and the servo flow at the same time. Thus, there is no pressure drop caused by a back-pressure valve or a flow distributor as in the case described in the introductory part of the description.

This enables a high efficiency to be obtained from the pump to the cylinder motors. A valve of the type represented by the valve 5 is also unaffected by dirt, compared with a flow distributor, meaning that operational disturbances resulting from dirt in the hydraulic oil have been substantially eliminated.

In accordance with a preferred embodiment of the invention, an electro-mechanical shunt valve 38 is coupled between the pump 2 and said pressure reducing valve 6, via a line 40, therewith to further reduce losses in the system. The shunt valve 38 includes electromagnetic means 39, such as a solenoid, for operating the valve slide. The shunt valve 38 is also connected to the tank 7 via a line 39. When open, the shunt valve 38 passes oil directly from the pump to the tank, substantially without losses in pressure. When closed, the shunt valve 38 blocks the connection to the tank.

The shunt valve 38 is arranged to take its closed position in response to a signal delivered from said auxiliary assemblies 13–17 when one of these assemblies is activated in a manner to activate, in turn, the servo-valve, which in the illustrated embodiment occurs when one of the operating levers 18–22 is manipulated. The electronic circuits in the auxiliary assemblies 13–17 deliver said signal via a line 42, which signal may comprise a drive current to a solenoid 39 for manouvering the slide of the shunt valve 38.

In this way, when no cylinder motor is activated, oil is pumped directly from the pump 2 to the tank 7, via the shunt valve 38, substantially without losses in pressure.

As a result of this embodiment, losses are held to a minimum, even when all oil is drained off.

When an operating lever is manipulated, the electromagnetic means 39 immediately closes the valve 38, whereupon the pressure in the system rises rapidly. When the servo pressure is reached, the valve 5 will quickly open.

The aforementioned disadvantages associated with known systems, inter alia, with respect to losses both when no cylinder motor is activated and in operation, are totally avoided by means of the present invention.

Despite the fact that these disadvantages are avoided, the servo-valve is always supplied with sufficient oil and is always under sufficient pressure.

The aforedescribed embodiment has been given by way of example only and is not restrictive of the invention.

As will be understood, many modifications can be made within the scope of the claims. For example, the auxiliary assemblies may have any suitable design. Similarly, the invention can be applied to systems incorporating any manner of main valve and servo-valve. The pressure restricting valve 6 may also have some other suitable form.

Thus, many modifications can be made within the concept of the invention as set forth in the following claims.

I claim:

1. An arrangement for supplying pilot oil to a servo-valve arranged to activate a main valve in a hydraulic system, said hydraulic system also including a hydraulic pump, and a pressure reducing valve located between the pump and the servo-valve, and at least one auxiliary assembly arranged to deliver an electric signal to electromagnetic means arranged to activate the servo-valve, characterized in that said valve (5) located between the pump (2) and the main valve (3) is arranged to be substantially closed when standing at a given, pre-determined pressure corresponding to the servo pressure required by the servo-valve (4) to fulfil its intended function, and said valve (5) is arranged to be open when said pressure slightly exceeds said predetermined pressure.

2. An arrangement according to claim 1 characterized in that said valve is fully closed.

3. An arrangement according to claim 1 or 2 in which there is more than one auxiliary assembly.

4. An arrangement according to claim 1 or 2 characterized in that said valve (5) includes a slide (28*a*) which is arranged for movement in a cylindrical bore (29) between a first position, in which it closes a passage way (27*a*, 30), and a second position in which said slide (28*a*) is axially displaced relative to said first position therewith to open said passageway (27*a*,30); and spring means (31) being provided for urging the slide (28*a*) in a direction towards said first position; and an oil operating line (32) is connected between said pump (2) and said valve (5) and extends to a chamber (33) in the cylinder bore (29), said operating line (32) being arranged to conduct oil having at least said pre-determined pressure such as to move the slide (29*a*) to its second position.

5. An arrangement according to claim 1 or claim 2, characterized in that there is arranged between said pump (2) and said pressure reducing valve (6) and electromagnetically operable shunt valve (38) which, when open, is able to pass oil directly from the pump (2) to a tank (7); and in that the shunt valve (28) is arranged to take its closed position upon receipt of a signal delivered from said at least one auxiliary assembly (13–17) when said one assembly is activated and, in turn, activates the servo-valve (4).

6. An arrangement according to claim 1 or 2 in which there are more than one auxiliary assembly and there is arranged between said pump (2) and said pressure reducing valve (6) an electromagnetically operable shunt valve (38) which, when open, is able to pass oil directly from the pump (2) to a tank 7; and the shunt valve (28) is arranged to take its closed position upon receipt of a signal delivered from said auxiliary assemblies (13–17) when one of these assemblies is activated and, in turn, activates the servo-valve (4).

* * * * *